US006735787B2

(12) United States Patent
Chen-Lieh

(10) Patent No.: US 6,735,787 B2
(45) Date of Patent: May 18, 2004

(54) DIVING MASK

(75) Inventor: Pan Chen-Lieh, Ilan Hsing (TW)

(73) Assignee: QDS Injection Molding LLC, San Diego, CA (US)

( * ) Notice: Subject to any disclaimer, the term of this patent is extended or adjusted under 35 U.S.C. 154(b) by 0 days.

(21) Appl. No.: 10/147,892

(22) Filed: May 20, 2002

(65) Prior Publication Data

US 2003/0213052 A1 Nov. 20, 2003

(51) Int. Cl.[7] ..... A61F 9/02
(52) U.S. Cl. ..... 2/428; 2/430
(58) Field of Search ..... 2/426, 427, 428, 2/430, 431, 432, 439, 440, 441, 442, 443; 351/41, 43

(56) References Cited

U.S. PATENT DOCUMENTS 5,138,723 A * 8/1992 Bolle ..... 2/430
5,345,615 A * 9/1994 Garofalo ..... 2/430
5,555,571 A * 9/1996 McCaffrey ..... 2/428
5,603,125 A * 2/1997 Chou ..... 2/428
6,032,298 A * 3/2000 Chiang ..... 2/428
6,098,206 A * 8/2000 Chou ..... 2/428
6,253,387 B1 * 7/2001 Yu ..... 2/428
6,341,863 B1 * 1/2002 Chen-Lieh ..... 351/43

* cited by examiner

*Primary Examiner*—Gary L. Welch
(74) *Attorney, Agent, or Firm*—Troxell Law Office PLLC

(57) ABSTRACT

A diving mask having a framing apparatus provided on both sides of a nose portion with at least front glasses mounted in front frame; and a mask apparatus made of a soft and flexible material. The mask apparatus includes a nose portion and an edging piece extending with the facial shape, on both sides of nose portion under the front frame, integrally forming lower frames and each frame having a lower lens.

7 Claims, 3 Drawing Sheets

DIVING MASK

FIELD OF THE INVENTION

The present invention is directed to a diving mask, especially a diving mask with a lower lens, which enables a diver to look downwardly and expand the view to diver's pectoral and waist regions.

BACKGROUND OF THE INVENTION

In diving, especially in scuba diving, one must use a diving mask. Since diving requires self-protection, personal security devices are extremely important. Among these devices, the diving mask is the most important and necessary one.

The conventional diving mask, such as U.S. Pat. No. 6,341,863, discloses a diving mask having a front lens and a side lens which provides wider view for the diver. There are a series of diving masks on the market which having the front lens and side lens which shown as FIG. 3.

When diving, except for the diver viewing an area around him through front lens and side lens, he must be able to observe his devices at any time. For example, he must look downwardly to observe a weight belt, buoyancy control harness, tangled hoses and related devices located around his waits. Under this circumstance, looking downwardly is unavoidable.

Therefore, U.S. Pat. No. 5,345,615 disclosed a diving mask having a lens for looking downwardly. In this patent, by the very complicate structure, under the front lens, a pair of second lens is provided which expands the view by allowing the diver to look down his pectoral region by forming a six window mask. This kind of mask having a pair of front lens, a pair of side lens, and a pair of lower lens (or auxiliary lens) under the front lens. Although it can achieve the basic function of looking downwardly, the disadvantage is that the frame of lower lens is made of a material different from the mask and must be combined with glue or sealed by a high frequency wave, which makes the production procedure more complicated and increases the cost.

SUMMARY OF THE INVENTION

In order to overcome the disadvantages, based on the long-termed experience in research and development as well as producing of diving mask, and through the intensive experiment, which resulted in the present invention of diving mask. The present invention provides a diving mask having six views and the frames of lens are formed integrally.

DETAILED DESCRIPTION OF THE PREFERRED EMBODIMENTS

Figure 1:
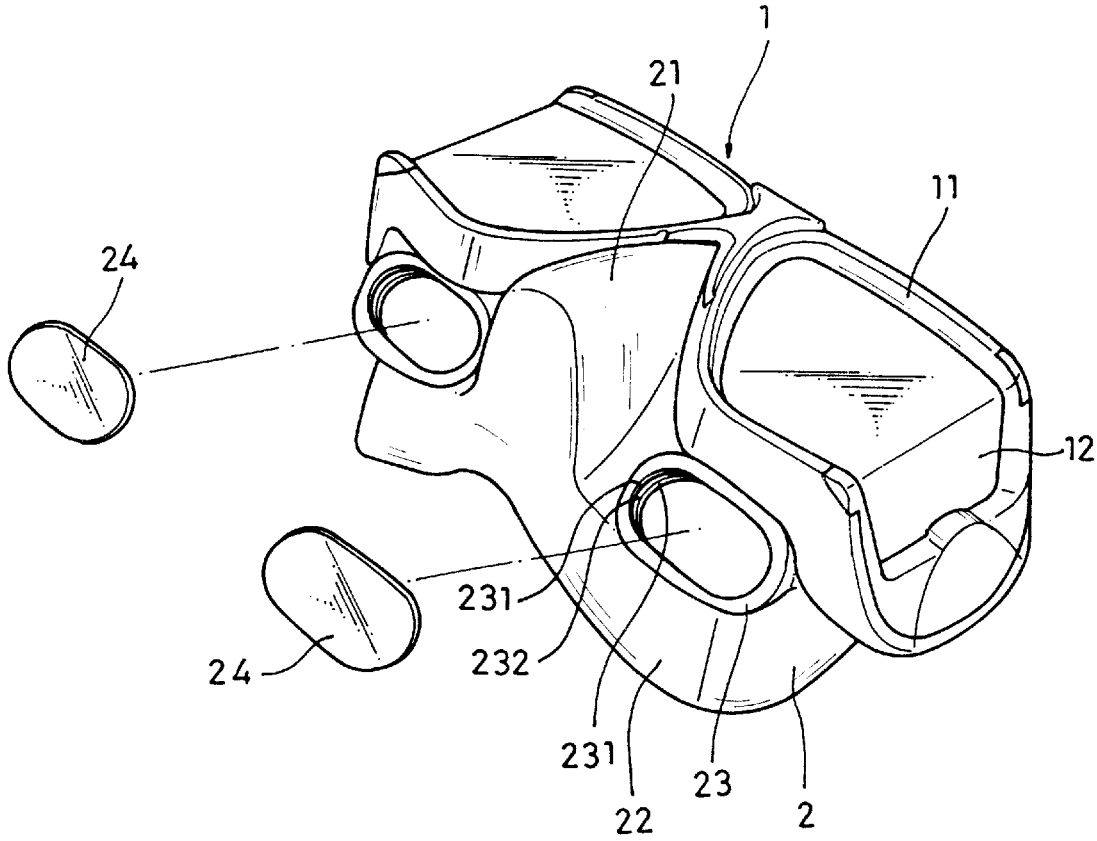
FIG. 1 is the perspective and explored view of the present invention.

Referring to the drawings, basically, the diving mask of the present invention comprising a framing apparatus 1 and a mask apparatus 2.

The framing apparatus 1 is composed of frames 11 and lens or glasses 12 which are combined with the mask apparatus during practice. The frames 11 have at least two front frames with glasses (or lens) 12. As shown in drawings, the frames 11 of diving mask of the present invention further comprise a pair of side frames with side lens extending from the front frames. The glasses 12 fill each frame closely and preferably made of, but not limited to, a transparent material such as reinforced glasses. Conventionally, the framing apparatus is adapted on both sides of nose portion 21 of the mask apparatus 2.

The mask apparatus 2 cover the driver's face closely when worn, therefore, its shape corresponds to the nose and eye portion of the face. In the middle, there is a swell up nose portion 21 for the nose of the diver. The edging piece 22 is integrally formed and extends downwardly to correspond with the driver's face.

The significant difference between the present invention and conventional diving mask is the frames 11. As showing in FIG. 1, inwardly extending from the lower edging piece 22 are lower frames 23, each having two frame rims 231 and a frame groove 232 for mounting a lower lens 24. As mentioned before, the mask apparatus 2 is made of a soft and flexible material. The size of groove 232 corresponds to the size of the lower lens 24, whereby the lower lens 24 can be fixed and positioned therein. For better protective viewing effect, the material of lower glasses 24 is, but not limited to, reinforced glass.

Figure 2:
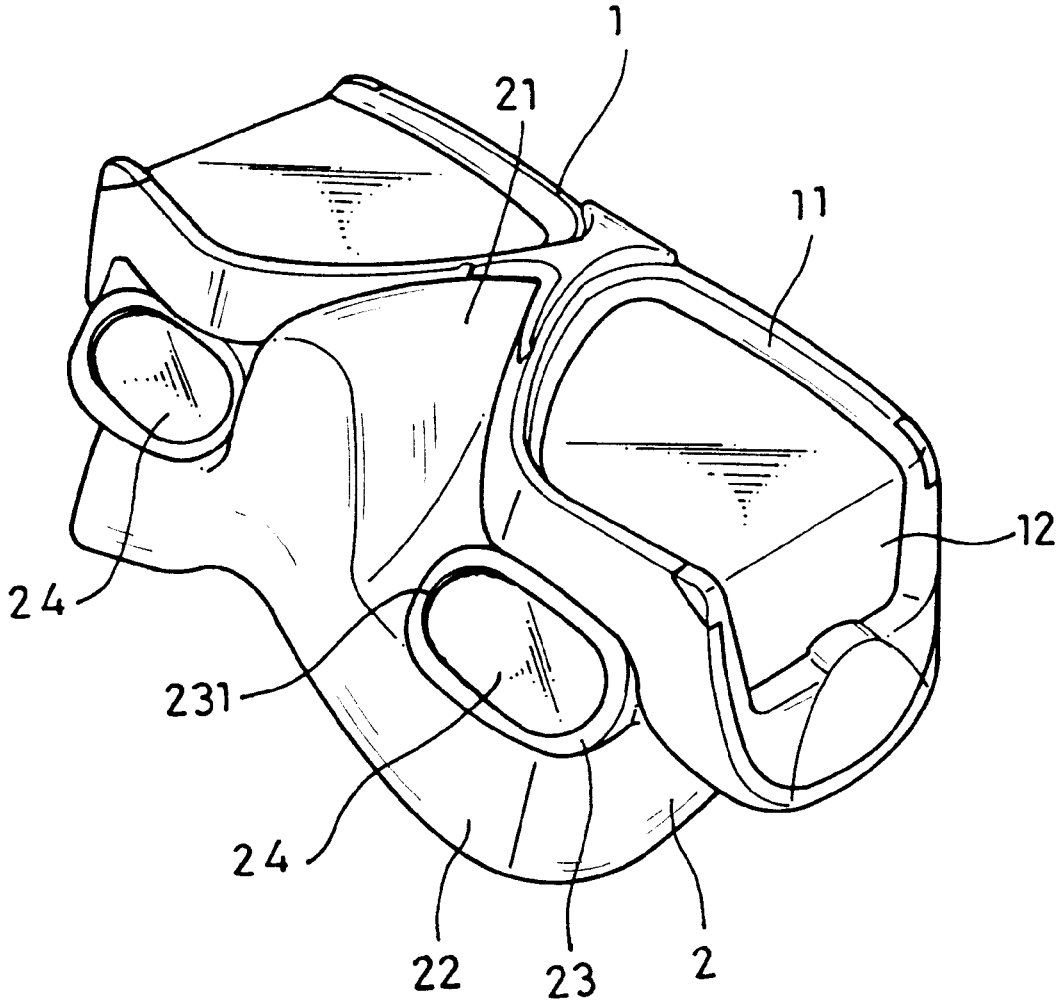
FIG. 2 is the perspective view of the present invention.
Figure 3:
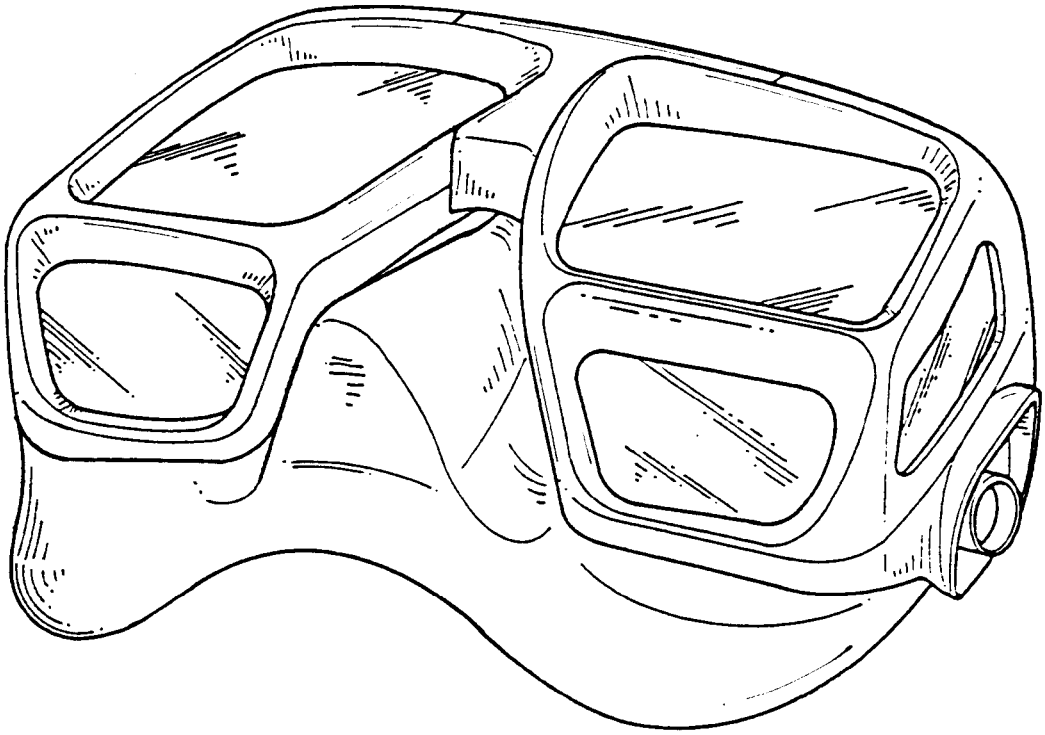
(PRIOR ART) FIG. 3
FIG. 3 is the drawing of one of the conventional diving mask.

Referring to FIG. 2, lower lens 24 can be mounted and fixed into the frame groove 232 to form a complete diving mask.

In practice, the lower lens 24 can be placed within the pre-design mold and formed integrally with mask apparatus 2. By this way, the lower glasses can be integrally surrounded by the mask apparatus 2, so as to be combined more closely.

Therefore, in the present invention, the diving mask with lower lens can be easily obtained and it is not achieved by the convention diving mask. In other words, the present invention is a breakthrough of diving mask technology.

The foregoing description of a preferred embodiment of the present invention has been by way of example and not of limitation. Understandably, many changes and modifications may be made thereunto within the scope of the inventive concept. It is understood that the invention scope should be that defined by the appended claims.

What is claimed is:

1. A diving mask comprising:

a) a framing apparatus having:

i) two upper frames; and ii) two upper lenses, each upper lens located in and connected to one of the two upper frames; and b) a mask apparatus connected to the framing apparatus and having:

i) a nose portion;

ii) a downwardly extending edging piece with a facial shape;

iii) two lower frames located on opposite sides of the nose portion; and iv) two lower lenses, each lower lens located in and connected to one of the two lower frames, wherein the two upper frames of the framing apparatus are located on opposite sides of the nose portion.

2. The diving mask according to claim 1, wherein the mask apparatus is made of a soft and flexible material.

3. The diving mask according to claim 1, wherein each of the two upper frames include a side frame with a side lens extending along an opposing side of the mask.

4. The diving mask according to claim 1, wherein the two lower lenses are formed integrally with the mask apparatus.

5. The diving mask according to claim 1, wherein each of the two lower frames include a frame rim with a frame groove, each of the lower lens being inserted into the frame groove of one of the two lower frames.

6. The diving mask according to claim 1, wherein the lower lenses are made of a transparent and rigid material.

7. The diving mask according to claim 1, wherein the lower lenses are made of reinforced plastic.

* * * * *